US008558765B2

(12) United States Patent
Cok

(10) Patent No.: US 8,558,765 B2
(45) Date of Patent: Oct. 15, 2013

(54) METHOD AND APPARATUS FOR UNIFORMITY AND BRIGHTNESS CORRECTION IN AN ELECTROLUMINESCENT DISPLAY

(75) Inventor: Ronald S. Cok, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 1259 days.

(21) Appl. No.: 11/765,686

(22) Filed: Jun. 20, 2007

(65) Prior Publication Data

US 2008/0055210 A1 Mar. 6, 2008

Related U.S. Application Data

(63) Continuation-in-part of application No. 11/268,253, filed on Nov. 7, 2005, now Pat. No. 8,207,914, and a continuation-in-part of application No. 11/512,940, filed on Aug. 30, 2006, now abandoned.

(51) Int. Cl.
*G09G 3/30* (2006.01)

(52) U.S. Cl.
USPC ..... 345/76; 345/204; 345/77; 345/82

(58) Field of Classification Search
USPC ..... 345/204, 76, 77, 82
See application file for complete search history.

(56) References Cited

U.S. PATENT DOCUMENTS

| | | | | |
|---|---|---|---|---|
| 6,081,073 | A | 6/2000 | Salam | |
| 6,177,915 | B1 * | 1/2001 | Beeteson et al. | 345/87 |
| 6,329,980 | B1 * | 12/2001 | Uehara et al. | 345/204 |
| 6,414,661 | B1 * | 7/2002 | Shen et al. | 345/82 |
| 6,473,065 | B1 | 10/2002 | Fan | |
| 6,961,037 | B2 * | 11/2005 | Kuwata et al. | 345/88 |
| 6,995,519 | B2 | 2/2006 | Arnold et al. | |
| 7,088,318 | B2 * | 8/2006 | Malmberg | 345/77 |
| 7,223,958 | B2 * | 5/2007 | Nakajima et al. | 250/216 |
| 7,301,618 | B2 * | 11/2007 | Cok et al. | 356/218 |
| 7,327,506 | B2 * | 2/2008 | Yui | 358/527 |
| 7,696,965 | B2 * | 4/2010 | Cok | 345/82 |
| 7,773,062 | B2 * | 8/2010 | Cok et al. | 345/77 |
| 7,817,115 | B2 * | 10/2010 | Yui | 345/76 |

(Continued)

FOREIGN PATENT DOCUMENTS

JP 2002-278514 9/2002

OTHER PUBLICATIONS

U.S. Appl. No. 11/268,253, filed Nov. 8, 2005, Cok et al.

*Primary Examiner* — Bipin Shalwala
*Assistant Examiner* — Afroza Chowdhury
(74) *Attorney, Agent, or Firm* — Global OLED Technology LLC

(57) ABSTRACT

A method for reducing brightness uniformity variations in an active-matrix electroluminescent (EL) display employing amorphous silicon thin-film transistors, by providing an active-matrix EL display having amorphous silicon thin-film transistors; and deriving a first correction value from a measured or estimated value of light-emitting element performance. Subsequently groups of light-emitting elements are identified, whereupon one or more representative light-emitting elements are selected. Remaining steps include measuring total representative current used by the representative light-emitting elements for each predetermined group of light-emitting element; deriving an estimated second correction value from the first correction value, or the measured or estimated value of light-emitting element performance, and the measured total representative currents for each individual light-emitting elements; and employing the estimated second correction value to correct image signals for the changes in the output of the light-emitting elements and produce compensated image signals.

24 Claims, 3 Drawing Sheets

(56) References Cited

U.S. PATENT DOCUMENTS

| | | | | |
|---|---|---|---|---|
| 8,207,914 | B2 * | 6/2012 | Cok et al. | 345/76 |
| 2002/0101395 | A1 * | 8/2002 | Inukai | 345/83 |
| 2002/0196264 | A1 * | 12/2002 | Goetz | 345/611 |
| 2004/0001037 | A1 | 1/2004 | Tsujimura | |
| 2004/0150590 | A1 * | 8/2004 | Cok et al. | 345/76 |
| 2005/0110420 | A1 * | 5/2005 | Arnold et al. | 315/169.3 |
| 2005/0151059 | A1 * | 7/2005 | Nakajima et al. | 250/208.1 |
| 2005/0180083 | A1 | 8/2005 | Takahara et al. | |
| 2005/0206965 | A1 * | 9/2005 | Nakayama et al. | 358/453 |
| 2005/0256062 | A1 * | 11/2005 | Li et al. | 514/28 |
| 2005/0269959 | A1 | 12/2005 | Uchino et al. | |
| 2005/0286062 | A1 * | 12/2005 | Yui | 358/1.9 |
| 2006/0009017 | A1 | 1/2006 | Sembommatsu et al. | |
| 2006/0139278 | A1 * | 6/2006 | Shingai et al. | 345/92 |
| 2006/0221326 | A1 * | 10/2006 | Cok et al. | 356/121 |
| 2007/0055724 | A1 * | 3/2007 | Harada et al. | 708/800 |
| 2007/0103411 | A1 * | 5/2007 | Cok et al. | 345/82 |
| 2007/0252782 | A1 * | 11/2007 | Yui | 345/58 |
| 2007/0290958 | A1 * | 12/2007 | Cok | 345/77 |
| 2008/0042943 | A1 * | 2/2008 | Cok | 345/77 |
| 2008/0055209 | A1 * | 3/2008 | Cok | 345/77 |
| 2008/0106501 | A1 * | 5/2008 | Cok et al. | 345/76 |

* cited by examiner

METHOD AND APPARATUS FOR UNIFORMITY AND BRIGHTNESS CORRECTION IN AN ELECTROLUMINESCENT DISPLAY

RELATED APPLICATIONS

This application is a Continuation-In-Part Application of U.S. patent application Ser. No. 11/268,253, filed Nov. 7, 2005, now U.S. Pat. No. 8,207,914 and is also a Continuation-In-Part of U.S. patent application Ser. No. 11/512,940, filed Aug. 30, 2006 (now abandoned).

FIELD OF THE INVENTION

The present invention relates to active-matrix electroluminescent (EL) displays employing amorphous silicon thin-film transistors and having a plurality of light-emitting elements and, more particularly to reducing brightness variations in the light-emitting elements in the display.

BACKGROUND OF THE INVENTION

Flat-panel display devices, for example plasma, liquid crystal and electroluminescent (EL) displays have been known for some years and are widely used in electronic devices to display information and images. EL display devices rely upon thin-film layers of materials coated upon a substrate, and include organic, inorganic and hybrid inorganic-organic light-emitting diodes (LEDs). The thin-film layers of materials can include, for example, organic materials, inorganic materials such as quantum dots, fused inorganic nano-particles; and electrodes, conductors, zinc oxide, and silicon electronic components as are known and taught in the LED art. Such devices employ both active-matrix and passive-matrix control schemes and can employ a plurality of light-emitting elements. The light-emitting elements are typically arranged in two-dimensional arrays with a row and a column address for each light-emitting element and having a data value associated with each light-emitting element to emit light at a brightness corresponding to the associated data value.

Typical large-format displays (e.g. having a diagonal of greater than 12 to 20 inches) employ hydrogenated amorphous silicon thin-film transistors (aSi-TFTs) formed on a substrate to drive the pixels in such large-format displays. The manufacturing process conventionally employed to form aSi-TFTs typically produces TFTs whose characteristics vary spatially over the surface of the substrate. However, the local aSi-TFT variation is typically relatively small so that neighboring TFTs will have similar characteristics while TFTs spaced further away will differ more. In contrast, smaller-format displays, (e.g. having a diagonal of less than 12-20 inches) generally use polysilicon, although amorphous silicon may be used as well, containing small crystalline structures that improve the mobility of the silicon and, hence, its performance. The crystals are typically formed by heating the surface of an amorphous silicon layer with a laser, for example an excimer laser. Exemplary patent application, US2006/0009017 filed by Scmbommatsu et al on 17 Jun. 2005, entitled "Method Of Crystallizing Semiconductor Film And Method Of Manufacturing Display Device" describes a method of uniformly crystallizing a semiconductor film through scanning with pulse lasers. However, this approach may lead to crystalline granules with variable performance so that neighboring TFTs can have quite different performance characteristics that are readily visible in a display using such polysilicon TFTs. Moreover, the annealing process is expensive. Hence, amorphous silicon thin-film transistors are characterized by large-scale non-uniformity and relatively low mobility, while polysilicon thin-film transistors are characterized by small-scale non-uniformity, relatively higher mobility, and higher cost.

Moreover, as described in "Threshold Voltage Instability Of Amorphous Silicon Thin-Film Transistors Under Constant Current Stress" by Jahinuzzaman et al in Applied Physics Letters 87, 023502 (2005), the aSi-TFTs exhibit a metastable shift in threshold voltage when subjected to prolonged gate bias. This shift is not significant in traditional display devices such as LCDs, because the current required to switch the liquid crystals in LCD display is relatively small. However, for LED applications, much larger currents must be switched by the amorphous silicon thin-film transistors (aSi-TFT) circuits to drive the electroluminescent materials to emit light. Thus, electroluminescent displays employing aSi-TFT circuits are expected to exhibit a significant voltage threshold shift as they are used. This voltage shift may result in decreased dynamic range and image artifacts. Moreover, the organic materials in organic EL (OLED) and hybrid EL devices also deteriorate in relation to the integrated current density passed through them over time, so that their efficiency drops while their resistance to current increases.

One approach to avoiding the problem of voltage threshold shift in TFT circuits is to employ circuit designs whose performance is relatively constant in the presence of such voltage shifts. For example, US2005/0269959 filed by Uchino et al, Dec. 8, 2005, entitled "Pixel Circuit, Active Matrix Apparatus And Display Apparatus" describes a pixel circuit having a function of compensating for characteristic variation of an electro-optical element and threshold voltage variation of a transistor. The pixel circuit includes an electro-optical element, a holding capacitor, and five N-channel thin-film transistors including a sampling transistor, a drive transistor, a switching transistor, and first and second detection transistors. Alternative circuit designs employ current-mirror driving circuits that reduce susceptibility to transistor performance. For example, US2005/0180083 filed by Takahara et al., Aug. 15, 2005 entitled "Drive Circuit For El Display Panel" describes such a circuit. However, such circuits are typically much larger and more complex than the two-transistor, single capacitor circuits often employed, thereby reducing the area on a display available for emitting light and decreasing the display lifetime.

Other methods useful for aSi-TFTs rely upon reversing or slowing the threshold-voltage shift. For example, US2004/0001037 filed Jan. 1, 2004 by Tsujimura et al., entitled "Organic Light-Emitting Diode Display" describes a technique to reduce the rate of increase in threshold voltage, i.e. degradation, of an amorphous silicon TFT driving an OLED. However, such schemes typically require complex additional circuitry, thereby reducing the geographical area on a display available for emitting light and decreasing the display lifetime.

JP 2002-278514 by Numeo Koji, published Sep. 27, 2002, describes a method in which a prescribed voltage is applied to organic EL elements by a current-measuring circuit and the current flows are measured; and a temperature measurement circuit estimates the temperature of the organic EL elements. A comparison is made with the voltage value applied to the elements, the flow of current values and the estimated temperature, the changes due to aging of similarly constituted elements determined beforehand, the changes due to aging in the current-luminance characteristics and the temperature at the time of the characteristics measurements for estimating the current-luminance characteristics of the elements. Then, the total sum of the amount of currents being supplied to the elements in the interval during which display data are displayed, is changed so as to obtain the luminance that is to be originally displayed, based on the estimated values of the current-luminance characteristics, the values of the current flowing in the elements, and the display data. This design is not useful for dealing with non-uniformities between different light-emitting elements or will require excessive measurement time.

It is known in the prior art to measure the performance of each pixel in a display and then to correct for the performance of the pixel to provide a more uniform output across the display. U.S. Pat. No. 6,081,073 entitled "Matrix Display with Matched Solid-State Pixels" by Salam and issued Jun. 27, 2000 describes a display matrix with a process and control means for reducing brightness variations in the pixels. This patent describes the use of a linear scaling method for each pixel based on a ratio between the brightness of the weakest pixel in the display and the brightness of each pixel. U.S. Pat. No. 6,473,065 entitled "Methods Of Improving Display Uniformity Of Organic Tight Emitting Displays By Calibrating Individual Pixel" by Fan, issued Oct. 29, 2002 describes methods of improving the display uniformity of an OLED. In order to improve the display uniformity of an OLED, the display characteristics of all organic-light-emitting-elements are measured, and calibration parameters for each organic-light-emitting-element are obtained from the measured display characteristics of the corresponding organic-light-emitting-element. The calibration parameters of each organic-light-emitting-element are stored in a calibration memory. The technique uses a combination of look-up tables and calculation circuitry to implement uniformity correction. However, these approaches require the performance measurement of each light-emitting element in the display. While this may be practical in a factory, it is not useful to accommodate changes in the device performance as it is used, since the measurements may take a considerable amount of time and therefore decrease the usability of the display during that time, discommoding the viewer of the display. Applicants have also determined through experimentation that, despite measures taken to reduce the instrumentation noise in the light-emitting element measurements, it may be difficult to consistently and accurately measure the light output from each of the light-emitting elements.

There is a need, therefore, for an improved method of providing uniformity in an active-matrix EL display having amorphous silicon thin-film transistors that overcomes these objections.

SUMMARY OF THE INVENTION

In accordance with one embodiment of the present invention for addressing the aforementioned needs a method for reducing brightness uniformity variations in an active-matrix EL display employing amorphous silicon thin-film transistors is disclosed. The method includes providing an active-matrix EL display having amorphous silicon thin-film transistors; and deriving a first correction value from a measured or estimated value of light-emitting element performance. Subsequently, groups of light-emitting elements are identified, whereupon one or more representative light-emitting elements are selected. Remaining steps include measuring total representative current used by the representative light-emitting elements for each predetermined group of light-emitting element; deriving an estimated second correction value from the first correction value, or the measured or estimated value of light-emitting element performance, and the measured total representative currents for each individual light-emitting elements; and employing the estimated second correction value to correct image signals for the changes in the output of the light-emitting elements and produce compensated image signals.

Another aspect of the present invention provides an active-matrix EL display that includes amorphous silicon thin-film transistors that drive a plurality of light-emitting elements responsive to an input signal that causes the light-emitting elements to emit light. The light-emitting elements are divided into a plurality of predetermined groups, each group comprising more than one light-emitting element and one or more representative light-emitting elements selected for each group of light-emitting elements. A controller coupled to the active-matrix EL display obtains a first correction value of current used by the light-emitting elements in response to known image signals at a first time. The controller also measures total representative current used by the representative light-emitting elements for each of the predetermined groups in response to known image signals at a second time.

ADVANTAGES

In accordance with various embodiments, the present invention provides the advantage of improved uniformity and lifetime in a display.

DETAILED DESCRIPTION OF THE INVENTION

Figure 1:
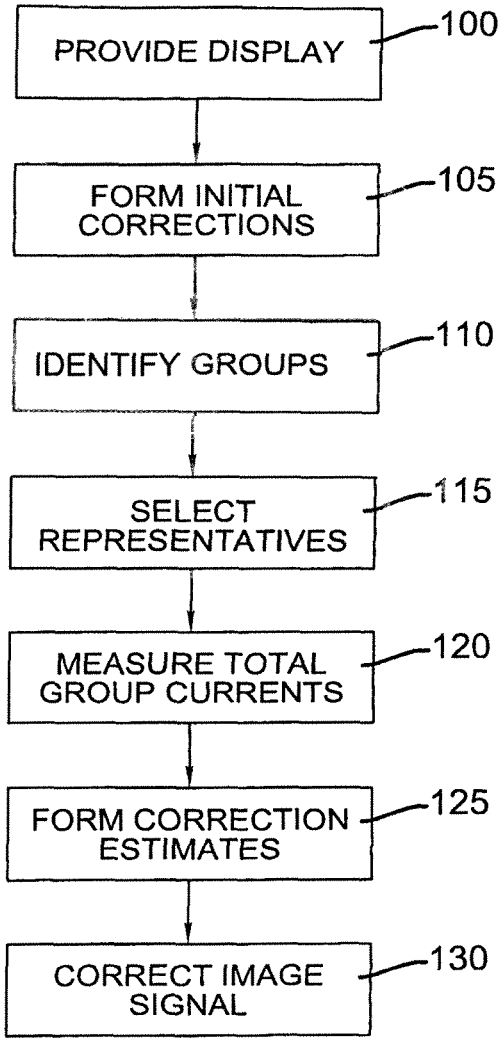
FIG. 1 is a flow diagram illustrating the method of the present invention.

Referring to FIG. 1, a method for reducing brightness uniformity variations in an active-matrix electroluminescent (EL) display employing amorphous silicon thin-film transistors is disclosed, comprising the steps of providing 100 an active-matrix EL display having amorphous silicon thin-film transistors that drive a plurality of light-emitting elements responsive to an input signal that cause the light-emitting elements to emit light; forming 105 a first correction value for each of the light-emitting elements derived from a measured or estimated value of light-emitting element performance in response to known image signals at a first time; identifying 110 a plurality of predetermined groups of light-emitting elements, the plurality of predetermined light-emitting groups including all of the light-emitting elements in the EL display, wherein each predetermined group of light-emitting elements includes more than one light-emitting element; selecting 115 one or more representative light-emitting elements for each predetermined group of light-emitting elements; measuring 120 total representative currents used by the representative light-emitting elements for each predetermined group of light-emitting element for each of the plurality of groups in response to known image signals at a second time; forming 125 an estimated second correction value derived from the first correction value or the measured or estimated value of light-emitting element performance in response to known image signals at a first time and the measured total representative currents for each individual light-emitting elements; and employing 130 the second correction value to compensate image signals for the changes in the output of the light-emitting elements and produce compensated image signals.

Figure 2:
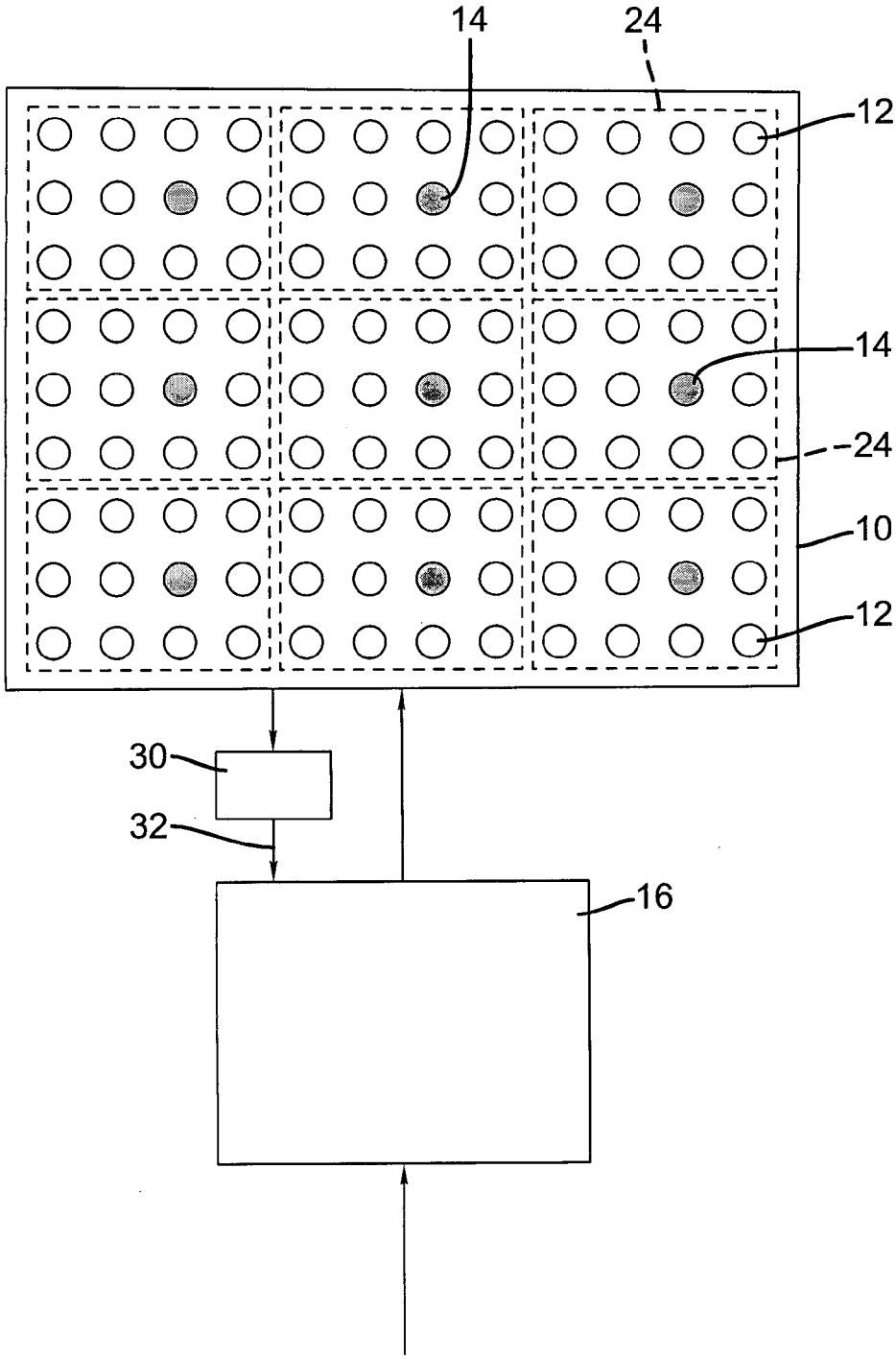
FIG. 2 is a schematic diagram illustrating a system having selected representative light-emitting elements useful for implementing the method of the present invention.

Referring to FIG. 2, an EL display 10 system comprises a plurality of light-emitting elements 12 divided into a plurality of groups 24, the groups representing all of the light-emitting elements 12, each group 24 comprising more than one light-emitting element 12. A controller 16 controls the EL display 10. A current measuring device 30 senses the total current used by the display 10 at any given time when driven by a known image signal that causes the display 10 to illuminate the representative light-emitting elements 14 in one of the groups 24 or to produce a total representative current signal 32.

In an initial step at a first time, the EL device may be calibrated, for example during manufacture, after manufacture and prior to product shipment, before the EL display is sold to a customer and put into use, or by display users before putting the display into operation. In this step, a first correction value derived from a measured or estimated value of light-emitting element performance in response to known image signals at a first time may be formed. In a particular embodiment, the current used by each individual light-emitting element 12 may be individually measured or estimated as a part of the manufacturing process. Pre-existing knowledge of the relationship between light output and current density through light-emitting elements can be employed to form the first correction value. Alternatively, the actual light output of each light-emitting element may be measured and the first correction value derived from the measurement. In other alternatives, the performance of some subset of the light-emitting elements may be measured or characterized to form a first correction value. Because this initial step may be performed before the device is put into use, more time and equipment may be employed to form an accurate correction without discommoding a user.

A plurality of predetermined groups of light-emitting elements are also identified, the plurality of predetermined light-emitting groups including all of the light-emitting elements in the EL display, wherein each predetermined group of light-emitting elements includes more than one light-emitting element and one or more representative light-emitting elements selected for each predetermined group of light-emitting elements. These representative elements are employed in subsequent display calibration modes, for example, automatically or by a user. Representative elements are employed to reduce the total number of measurements and to reduce the obtrusiveness of the measurements (because not every light-emitting element may be measured). Moreover, by employing more than one representative element in a group, the current used is increased and, since the current used by each light-emitting element may be very small, a more accurate and less expensive measurement made.

In a display calibration mode, controller 16 provides known image signals that activate all of the representative light-emitting elements 14 in each group 24 at the same time. The current used by each group 24 is measured separately so that a total current used by all of the representative light-emitting elements 14 in each group is separately obtained. From the total representative current values for each group 24, the controller 16 may form estimated values of current used by each individual light-emitting elements and stores at least one estimate of current used. By specifying representative light-emitting elements of groups, improved current measurement speed may be realized compared to measuring the performance of every light-emitting element in the groups.

The controller 16 also calculates a correction value for each light-emitting element 12 in each group 24. After the display is used for some time, the current used by the representative elements in each group 24 may be measured again and new correction values based on a comparison between the instant estimated values of current used and prior estimated or measured values of current. The correction values may be employed to compensate image signals for the changes in the output of the light-emitting elements 12 and produce compensated image signals. Alternatively, correction values for at least one light-emitting element may be estimated by interpolating between correction values for other light-emitting elements.

In a first simple case, groups of non-overlapping light-emitting elements 12 may be defined as shown in FIG. 2, for example comprising a twelve-by-nine array of light-emitting elements 12 divided into groups 24 of four-by-three light-emitting elements 12. A single representative light-emitting element 14 may be selected within each group 24, for example, near the spatial center of the group 24. A known signal may be employed by the controller 16 to illuminate the representative light emitters 14 to form total representative currents for each group. In this case, because the characteristics of aSi-TFT change relatively slowly with respect to its location on a substrate, the performance of each light-emitter 12 within a group 24 may be presumed to be the same as the current of the single representative light emitter 14. Because only a single measurement of each group is employed, the number of measurements is greatly reduced (in this case by a factor of 12) and because only a single light-emitter was illuminated to obtain the current measurement, the measurement is relatively unobtrusive. To further improve the quality of the image signal correction, the correction values for each individual light emitter 12 may be spatially interpolated from the representative light emitters. Further speed improvements may be obtained by increasing the number of light emitters 12 defined within a group 24 and to further improve the quality of the measured current signal, multiple representative light-emitting elements 14 may be used within a group.

Figure 3:
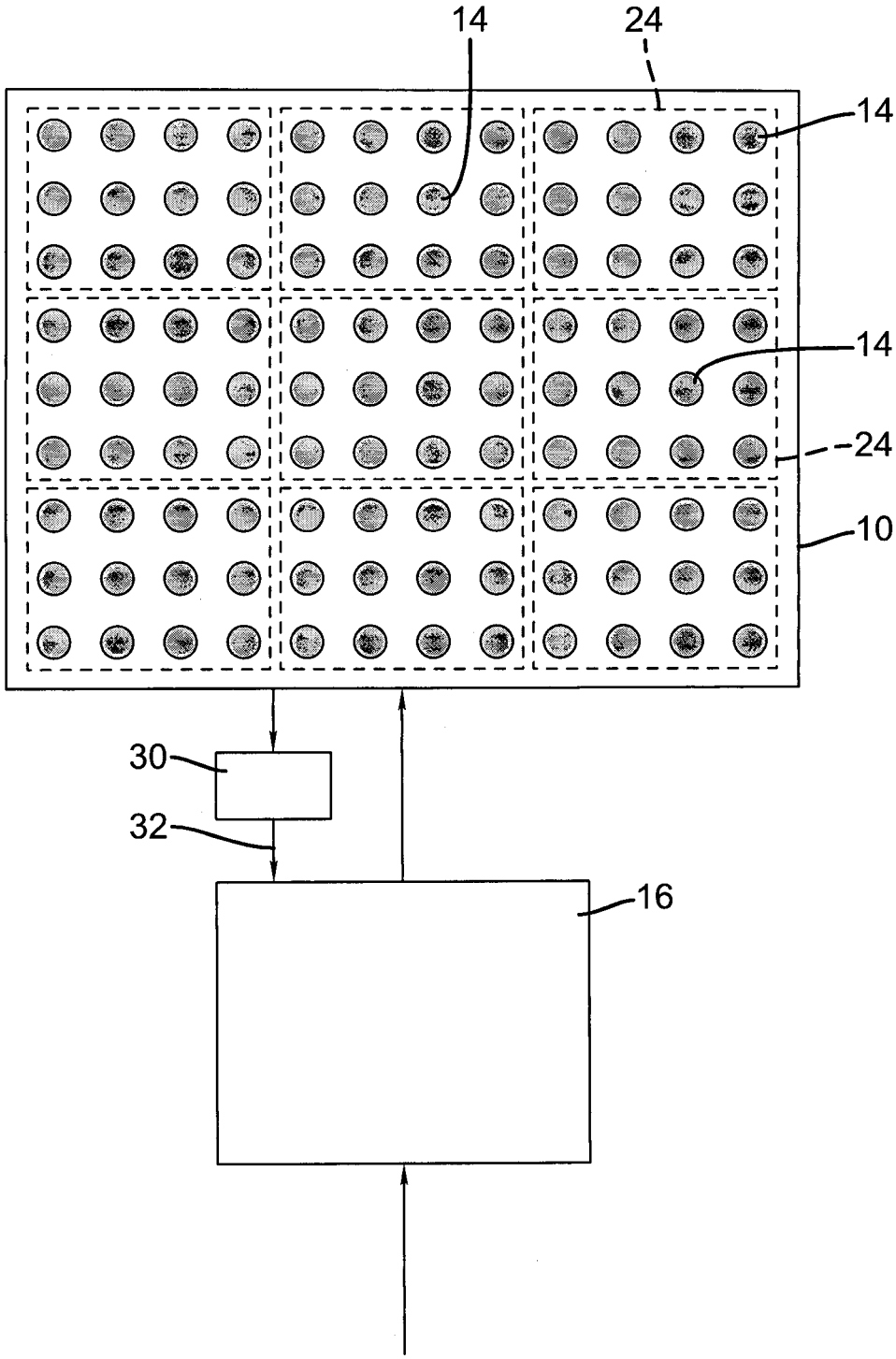
FIG. 3 is a schematic diagram illustrating a system having different selected representative light-emitting elements useful for implementing the method of the present invention.

In a second simple case, for example, the same groups 24 of non-overlapping light-emitting elements 12 may be defined as shown in FIG. 3. All of the light-emitting elements in each group 24 may be chosen as representative light-emitting elements 14. A known signal may be employed by the controller 16 to illuminate the representative light emitters 14 to form a total representative current for each group. In this case, that means that all of the light emitters in the group are illuminated. Again, because the characteristics of aSi-TFT change relatively slowly with respect to their location on a substrate, the performance of each light-emitter 12 within a group 24 may be presumed to be the same as the total representative current divided by the number of representative light emitters (e.g. 12). Because only a single measurement of each group is employed, the number of measurements is greatly reduced (in the exemplary case by a factor of 12). Compared to the previous example, the representative pixel illumination is more visible and obtrusive; however, the error in the measurement is much smaller, since it is a combined measurement of multiple light-emitting elements and an average value may, therefore, be employed. To further improve the quality of the image signal correction, the correction values for each individual light emitter 12 may be spatially interpolated between the groups. Further speed improvements may be obtained by increasing the number of light emitters 12 defined within a group 24.

In other cases, the representative light-emitting elements 14 comprise more than one, but fewer than all of the light-emitting elements 12 in a group. For example, the representative light-emitting elements may comprise a regular array of samples within a group to obtain a more representative total group current measurement. It is also possible to reduce the measurement error by repeating measurements or by specifying different sets of representative light-emitting elements for each group. Different total representative currents are measured for each group and then combined to form a total representative current measurement, for example, by averaging two measurements.

The steps of measuring the total representative current for each group and then calculating a new correction value may be repeated over time to repeatedly correct the display and maintain the display at a substantially constant desired brightness, for example, an initial brightness, or at least to maintain the brightness of the display within a desired range, such as within 10% of the initial brightness of the display. Moreover, a plurality of different input signal values and a plurality of correction values may be estimated for each light-emitting element. For example, a different correction value may be formed for a plurality of different luminance values, providing a more accurate correction at various gray scale values employed by the display. To form such different corrections, it is only necessary to repeat the performance and/or current measurements of initial and subsequent performance at different luminance levels using suitable, known image signals of difference luminance, and then form correction values at each of the different luminance levels.

LED devices and displays comprising a plurality of individual light-emitting elements 12 are known in the art, as are controllers for driving LEDs, performing calculations, and correcting image signals, for example by employing look-up tables or matrix transforms. In particular, controllers employing digital logic circuits can be employed to calculate correction values for individual light-emitting elements 12, based on the difference between the first and second current values; and to employ the correction values to compensate image signals for the changes in the output of the light-emitting elements, and can produce compensated image signals. The current measuring device 30 can comprise, for example, a resistor connected across the terminals of an operational amplifier, as is known in the art.

In one embodiment, the display 10 is a color image display comprising an array of pixels, each pixel including a plurality of differently colored light-emitting elements 12 (e.g. red, green, and blue) that are individually controlled by the controller circuit 16 to display a color image. The colored light-emitting elements 12 may be formed by different organic light-emitting materials that emit light of different colors; alternatively, they may all be formed by the same organic white light-emitting materials with color filters provided over the individual elements to produce the different colors. In another embodiment, the light-emitting elements 12 are individual graphic elements within a display and may not necessarily be organized as an array. In either embodiment, the light-emitting elements may have either passive- or active-matrix control and may either have a bottom-emitting or top-emitting architecture. The first and second measurements may be done separately for each color of light-emitting element.

According to various embodiments of the present invention, the groups may be of different sizes, for example, depending on the resolution of the display, the number of light-emitters, and the time available to make the current measurements for each group. Large displays may employ larger groups, and applications in which more time is available for current measurement may employ smaller groups of light-emitting elements 12. Moreover, groups may overlap and individual representative light-emitting elements 12 may be found in more than one group, thus further reducing the number of measurements and improving the accuracy of corrections. It is also possible to re-determine the groups after the first correction value is derived and measure the total representative current for each of the re-determined groups. This may be useful, for example, if it is more convenient to group light-emitting elements 12 in a first way during manufacturing when the initial measurements are made using one set of tools and in a second, different way using another set of tools during use. In another alternative, different sets of representative light-emitting elements 14 are specified for each group and different total representative currents are measured for each group and then combined to form a total representative current measurement. Hence, each group and the corresponding representative elements 14 need not be identical or treated identically, particularly if some pre-existing knowledge concerning the device or its usage indicates that differences in usage will affect the device's performance.

In general, there are several factors, some technology dependent, for performance degradation in active-matrix EL displays employing amorphous silicon thin-film transistors for driving the LED. First, as noted above, the voltage threshold of the amorphous silicon transistors generally increases over time so that a higher gate input voltage is necessary to achieve a similar current from the source to the drain of the transistor. In the case of organic EL and hybrid EL devices, as the organic materials degrade over time and with repetitive use, the ohmic resistance through those degraded organic materials increases. Additionally, organic materials may lose efficiency with age, so that an increasing amount of current is necessary to achieve a constant light output.

In many cases, the aging and brightness of materials is related to the temperature of the LED device and materials when current passes through them. Hence, in a further embodiment of the present invention, a temperature sensor providing a temperature signal may be constructed on or adjacent to the LED display 10 and the controller 16 may also be responsive to a temperature signal to calculate the correction value or perform measurements only when the device is within a pre-determined temperature range.

A model of the luminance decrease and its relationship to the decrease in current at a given driving voltage may be generated by driving an EL display with a known image signal and measuring the change in current and luminance over time. A correction value for the known image signal necessary to cause the EL display to output a nominal luminance for a given input image signal may then be determined for each type of material in the EL display 10. The correction value is then employed to calculate a compensated image signal. Thus, by controlling the signal applied, an EL display with a constant luminance and white point may be achieved and localized aging corrected.

Typically, there are very many light-emitting elements within an EL display and individual elements require only very small amounts of current (e.g. picoAmps) that are difficult to measure. By employing representative light-emitting elements 14 for groups of light-emitting elements that are turned on together, the current used is larger and the measurements are easier and more accurate. At the same time, fewer measurements are necessary. Combining the various total current measurements and deriving the individual light-emitting element current usage from the combination of measurements improves the accuracy of the estimates for each light-emitting element 12.

During subsequent correction value calculation cycles, the estimated current values for each light-emitting element 12 are typically compared to the first estimates, correction values, or measurements to calculate a correction value based on the changes in estimated current values since the EL device was originally put into service. In this way, the EL device performance is maintained in its initial operating state. Although different groups may be employed in subsequent corrections, typically the same groups are employed each time. However, in the case that substantial changes have occurred in some areas, groups may be modified to enhance the accuracy of the estimates; for example, groups may be made smaller, groups may overlap to a greater extent, or sampled groups may be employed.

As the LED device is used and the LED materials age, new correction values may be calculated, as often as desired. Because the measurements are done on representative light-emitting elements 14 of a group, the amount of time required to take the measurements is much reduced over the time required to do a measurement separately for each light emitter. Moreover, the current measurements for groups of light-emitters may be advantageously much easier to make and relatively more accurate, since the current used by a single light-emitter is very small and difficult to reliably measure while the current used by more than one representative light-emitters 14 is much larger and less noisy. At the same time, by employing groups containing at least one common light-emitting element and by carefully combining the current measurements of each group, the correction for each light-emitter may be customized, improving the correction of image signals.

A variety of calculation methods may be employed to estimate current usage and calculate a correction value for each light-emitting element for each of the groups. Co-pending, commonly assigned U.S. application Ser. No. 11/093,115 and LED-1951 all discuss methods for measuring and estimating light-emitting element performance and are hereby incorporated in their entirety by reference. The estimates for each light-emitting element may be formed by interpolating from the total representative current measurements for each group. Alternatively, correction values for at least one light-emitting element may be estimated by interpolating between correction values for other light-emitting elements. An exemplary method is to interpolate a more accurate estimate value for each light-emitting element 12 depending on the spatial location of the light emitter within the group of which it is a member and the total representative current measurement values. A great variety of interpolation calculations are known in the mathematical arts. An individual correction value may then be calculated for each light-emitting element 12. In a specific embodiment, each light-emitting element 12 within a group may be presumed to consume the same current, and a common correction value for each light-emitting element of the group may be calculated by comparing the representative current measurements at first and second times and estimates for the individual light-emitting elements may be interpolated from the correction values for each group. A variety of transformations or calculations may be employed in concert with the present invention, for example, the measured or calculated data may be converted from one mathematical space (e.g. linear) to another (e.g. logarithmic), or vice versa.

It is also possible to iteratively improve the correction in particular areas of interest. For example, a larger group size having a number of representative light-emitting elements 14 may be employed to quickly find areas that have significantly changed current measurements implying differential aging in the EL device. Smaller groups having the same number of representative light-emitting elements 14 may then additionally be defined and total representative current measurements taken for the smaller groups. Since the smaller groups will provide a relatively larger number of measurements, the interpolation calculation for individual light-emitting elements may be more accurate, resulting in an improved image signal correction. This process may be repeated for increasingly smaller groups until an adequate correction for the display application is determined. The group sizes chosen may be relevant to the size of the information content representation employed on a display, for example, icon size or text size. The interpolation for light-emitting elements for the smaller groups may rely on combinations of measurements for the smaller groups alone or on combinations of measurements for the larger groups and the smaller groups together.

Over time the LED materials may age, the resistance of the LEDs increase, the current used at the given input image signal will decrease and the correction will increase. For organic and hybrid EL devices, there may be a point in time when the controller circuit 16 will no longer be able to provide an image signal correction that is large enough such that the display can no longer meet its brightness or color specification, and the display will have reached the end of its optimal performance lifetime. However, the display will continue to operate as its performance declines in a graceful degradation of its usefulness. Moreover, the time at which the display can no longer meet its specification can be signaled to a user of the display when a maximum correction is calculated, thus providing useful feedback on the performance of the display. Alternatively, the overall display brightness may be reduced to enable the correction of local defects in light output.

The present invention can be constructed simply, requiring only (in addition to a conventional display controller) a current measurement circuit, a memory, and a calculation circuit to determine the correction for the given image signal. No current accumulation or time information is necessary. Although the display may be periodically removed from use to update the measurements as the EL device is used, the frequency of measurement may be quite low, for example months, weeks, days, or tens of hours of use. The correction value calculation process may be performed periodically during use, at power-up or power-down, when the device is powered but idle, or in response to a user signal. The measurement process may take only a few milliseconds for a group so that the effect on any user is limited. Representative light-emitting elements 14 may be measured at different times to further reduce the impact on any user.

The present invention can be used to correct for changes in color of a color display. As noted above, as current passes through the various light-emitting elements 12 in the pixels, the materials for each color emitter will age differently. By creating groups comprising light-emitting elements 12 of a given color, and measuring the current used by the display for representative light-emitting elements of that group, a correction for the light-emitting elements 12 of the given color can be calculated separately from those of a different color.

The present invention may be extended to include complex relationships between the corrected image signal, the measured current, and the aging of the materials. Multiple image signals may be used corresponding to a variety of display outputs. For example, a different image signal may be employed for each display brightness level. When calculating the correction values, a separate correction value may be obtained for each display brightness level by using different image signals. A separate correction signal is then employed for each display brightness level required. As noted above, this can be done for each light-emitting element group, for example, different light-emitting element color groups. Hence, the correction values may correct for each display brightness level, for each color, as each material ages.

LED displays dissipate significant amounts of heat and become quite hot when used over long periods of time. Further experiments by applicant have determined that there is a strong relationship between temperature and current drawn by the light-emitting elements, possibly due to relationship of voltage dependence of an LED display and temperature. Therefore, if the display has been in use for a period of time, the temperature of the display may need to be taken into account in calculating the correction value. If, on the other hand, it is assumed that the display has not been in use, or if the display is cooled, it may be assumed that the display is at a pre-determined ambient temperature, for example room temperature, and the temperature of the display may not need to be taken into account in calculating the correction value. For example, mobile devices with a relatively frequent and short usage profile might not need temperature correction, if the display correction value is determined at power-up. Display applications for which the display is continuously on for longer periods, for example, monitors or televisions, might require temperature accommodation, or can be corrected on power-up to avoid display temperature issues.

If the display is calibrated at power-down, the display may be significantly hotter than the ambient temperature and it is preferred to accommodate the calibration by including the temperature effect. This can be done by measuring the temperature of the display, for example, with a thermocouple placed on the substrate or cover of the device; or a temperature-sensing element, such as a thermistor is integrated into the electronics of the display. Additionally, one can wait until the display temperature has reached a stable point and measure the temperature at that time. For displays that are constantly in use, the display is likely to be operated significantly above ambient temperature and the temperature can be taken into account for the display calibration. A temperature sensor (not shown) provides a temperature signal that may be employed by the controller 16 to more accurately correct current measurements and image signals.

To further reduce the possibility of complications resulting from inaccurate current readings or inadequately compensated display temperature, the controller may limit changes to the correction signals applied to the input image signals. For example; the correction value for a light-emitting element 12 may be restricted to increase monotonically, limited to a pre-determined maximum change; calculated to maintain a constant average luminance output for the light-emitting element 12 over its lifetime; calculated to maintain a decreasing level of luminance over the lifetime of the light-emitting element 12, but at a rate slower than that of an uncorrected light-emitting element; or calculated to maintain a constant white point for the light-emitting element.

More specifically, since the aging process may not reverse, a calculated correction value might only increase monotonically. Any change in correction can be limited in magnitude, for example, to a 5% change. Correction changes can also be averaged over time; for example, an indicated correction change can be averaged with the previous value(s) to reduce variability. Alternatively, an actual correction can be made only after taking several readings, for example, every time the device is powered on, a correction calculation is performed and a number of calculated correction values (e.g. 10) are averaged to produce the actual correction value that is applied to the image signals. If a display is consistently used in a hot environment, it may be desirable to reduce the current provided to the display to compensate for increased conductivity in such an environment.

The corrected image signal may take a variety of forms depending on the EL display device. For example, if analog voltage levels are used to specify the image signal, the correction will modify the voltages of the image signal. This can be done using amplifiers as is known in the art. In a second example, if digital values are used that correspond to a charge deposited at an active-matrix light-emitting element location, a lookup table may be used to convert the digital value to another compensated digital value, as is well known in the art. In a typical EL display device, either digital or analog video signals are used to drive the display. The actual EL may be either voltage- or current-driven depending on the circuit used to pass current through the LED. Again, these techniques are well known in the art.

The correction values used to modify the input image signal to form a compensated image signal may be used to control a wide variety of display performance attributes over time. For example, the model used to supply correction signals to an input image signal may hold the average luminance or white point of the display constant. Alternatively, the correction signals used to create the corrected image signal may allow the average luminance to degrade more slowly than it would otherwise due to aging or the display control signals may be selected to maintain a lower initial luminance to reduce the visibility of changes in device efficiency.

In an exemplary embodiment, the present invention is employed in a flat-panel OLED device composed of small molecule or polymeric OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al. In another preferred embodiment, the present invention is employed in a flat-panel inorganic LED device containing quantum dots as disclosed in, but not limited to U.S. Patent Application Publication No. 2007/0057263 entitled "Quantum dot light emitting layer" and pending U.S. application Ser. No. 11/683,479, by Kahen, which are both hereby incorporated by reference in their entirety. Many combinations and variations of organic, inorganic and hybrid light-emitting displays can be used to fabricate such a device, including both active-matrix LED displays having either a top- or bottom-emitter architecture The invention has been described in detail with particular reference to certain preferred embodiments thereof, but it will be understood that variations and modifications can be effected within the spirit and scope of the invention.

PARTS LIST

10 display
12 light-emitting element
14 representative light-emitting element
16 controller
24 group
30 current measurement device
32 current signal
100 provide display step
105 form initial corrections step
110 define groups step
115 select representative light-emitting elements step
120 measure total group currents step
125 form correction estimates step
130 correct image step

The invention claimed is:

1. A method for reducing brightness uniformity variations in an active-matrix electroluminescent (EL) display employing amorphous silicon thin-film transistors, comprising the steps of:

a) providing an active-matrix EL display having amorphous silicon thin-film transistors that drive a plurality of light-emitting elements responsive to an input signal that causes the light-emitting elements to emit light;

b) deriving a first correction value from a measured or estimated current used or from a measured light output emitted by the light-emitting element in response to known image signals at a first time;

c) identifying a plurality of predetermined groups of light-emitting elements, the plurality of predetermined light-emitting groups including all of the light-emitting elements in the EL display, wherein each predetermined group of light-emitting elements includes more than one light-emitting element;

d) selecting one or more representative light-emitting elements for each predetermined group of light-emitting elements, wherein, in each predetermined group, the number of the representative light-emitting elements is fewer than the number of the light-emitting elements;

e) measuring total representative current used by the representative light-emitting elements for each predetermined group of light-emitting element in response to known image signals at a second time;

f) deriving an estimated second correction value from i) the first correction value, or the measured or estimated current used or the measured light output emitted by the light-emitting element in response to known image signals at the first time, and ii) the measured total representative currents for each individual light-emitting elements; and g) employing the estimated second correction value to correct image signals for the changes in the output of the light-emitting elements in each predetermined group and produce compensated image signals, wherein the method employs only a single measurement of the total representative current per each predetermined group, and the frequency of the measurements is tens of hours of use.

2. The method of claim 1, wherein steps e) through g) are repeatable.

3. The method of claim 1, wherein the estimates for each light-emitting element are calculated by interpolating from the total representative current measurements for each predetermined group.

4. The method of claim 1, wherein a correction value for at least one light-emitting element is estimated by interpolating between correction values for other light-emitting elements.

5. The method of claim 1, wherein a single representative light-emitting element is selected.

6. The method of claim 1, wherein the representative light-emitting elements comprise more than one but fewer than all of the light-emitting elements in a group.

7. The method of claim 6, wherein the representative light-emitting elements comprise a regular array of samples within a group.

8. The method of claim 1, wherein the current used by the light-emitting element in the step of deriving the first correction value is measured at a plurality of luminance levels.

9. The method of claim 1, wherein the correction values for one or more of the light-emitting elements is calculated by interpolating the measured total representative current values.

10. The method of claim 1, wherein the EL display luminance is held substantially constant.

11. The method of claim 1, further comprising the steps of re-determining the groups after the first correction value is derived and measuring the total representative current for each of the re-determined groups.

12. The method of claim 1, wherein the EL display is a color display comprising light-emitting elements of multiple colors and wherein the measurements are done separately for each color of light-emitting element.

13. The method of claim 1, wherein the total representative current for each group is measured for a plurality of different input signal values and a plurality of correction values are estimated for each light-emitting element.

14. The method of claim 1, wherein different sets of representative light-emitting elements are specified for each group and different total representative currents are measured for each group and then combined to form a total representative current measurement.

15. An active-matrix EL display, comprising:

a) an active-matrix EL display having amorphous silicon thin-film transistors that drive a plurality of light-emitting elements responsive to an input signal that causes the light-emitting elements to emit light; the light-emitting elements divided into a plurality of predetermined groups, each group comprising more than one light-emitting element and one or more representative light-emitting elements selected for each group of light-emitting elements, wherein, in each predetermined group, the number of the representative light-emitting elements is fewer than the number of the light-emitting elements; and b) a controller coupled to the active-matrix EL display that obtains a first correction value from a measured or estimated current used or from a measured light output emitted by the light-emitting elements in response to known image signals at a first time; and also that measures total representative current used by the representative light-emitting elements for each of the predetermined groups in response to known image signals at a second time, wherein the controller employs only a single measurement of the total representative current per each predetermined group, and the frequency of the measurements is tens of hours of use, wherein the controller further comprises:

means for forming an estimated second value of the current used by individual light-emitting elements based on the measured total representative currents;

means for calculating correction values for individual light-emitting elements based on the difference between the first and second measurements; and means for employing the correction values to compensate image signals for the changes in the output of the light-emitting elements in each predetermined group and produce compensated image signals.

16. The method of any of claims 1 and 15, wherein the EL display is an organic light-emitting diode (OLED) display.

17. The active matrix EL display of claim 15, wherein the EL display is an OLED display.

18. The method of claim 7, wherein the predetermined group of the light-emitting elements comprises light-emitting elements arranged in two-dimensional arrays.

19. The active-matrix EL display of claim 15, wherein the each predetermined group comprises more than one representative light-emitting elements selected for each predetermined group of the light-emitting elements.

20. The active-matrix EL display of claim 15, wherein the predetermined group of the light-emitting elements comprises light-emitting elements arranged in two-dimensional arrays.

21. The method of claim 1, wherein the frequency of the measurements is days of use.

22. The method of claim 1, wherein the frequency of the measurements is one week of use.

23. The active-matrix EL display of claim 15, wherein the frequency of the measurements is weeks of use.

24. The active-matrix EL display of claim 15, wherein the frequency of the measurements is months of use.

* * * * *